United States Patent [19]

Scherbing

[11] 4,394,551

[45] Jul. 19, 1983

[54] SWITCH LOCK

[75] Inventor: Frank J. Scherbing, River Grove, Ill.

[73] Assignee: Fort Lock Corporation, River Grove, Ill.

[21] Appl. No.: 257,491

[22] Filed: Apr. 24, 1981

[51] Int. Cl.[3] ..... H01H 9/28

[52] U.S. Cl. ..... 200/44; 200/293

[58] Field of Search ..... 200/293, 307, 44, 155 R, 200/11 J, 11 G, 42 R

[56] References Cited

U.S. PATENT DOCUMENTS

| | | | |
|---|---|---|---|
| 1,462,684 | 7/1923 | Clum | 200/44 |
| 1,748,013 | 2/1930 | Douglas | 200/44 |
| 2,663,780 | 12/1953 | Hept et al. | 200/44 |
| 2,778,891 | 1/1957 | Jacobi | 200/44 |
| 3,917,919 | 11/1975 | Tahara | 200/44 |
| 3,975,604 | 8/1976 | Appleton | 200/307 |
| 4,147,905 | 4/1979 | Scherbing | 200/44 |
| 4,227,056 | 10/1980 | Johnston et al. | 200/44 |
| 4,258,237 | 3/1981 | Beck | 200/11 J |

FOREIGN PATENT DOCUMENTS

| | | | |
|---|---|---|---|
| 2137690 | 2/1973 | Fed. Rep. of Germany | 200/44 |

*Primary Examiner*—John W. Shepperd

*Attorney, Agent, or Firm*—Leydig, Voit, Osann, Mayer & Holt, Ltd.

[57] ABSTRACT

An electrical switch operating subassembly for a mechanical key-actuated lock which may be readily and easily incorporated into commonly utilized lock sizes and which may be likewise disassembled for rekeying and changing of switch contact elements, the essential components of which are two contact effecting interfitting members that are removably insertable in the lock cylinder and which coact with one another to make and break an electrical circuit upon rotation of the lock operating spindle with a proper key and also provide the rotational limits of the lock for switch-on and switch-off positions.

8 Claims, 20 Drawing Figures

SWITCH LOCK

FIELD OF THE INVENTION

The present invention relates generally to key-actuated lock mechanisms including electrical switching capabilities and more particularly to an improved switch lock subassembly arrangement which can be used with a variety of forms of locks specifically including axial pin tumbler locks to readily adapt such locks to accept electrical switching capabilities.

BACKGROUND AND OBJECTS OF THE INVENTION

The adaptation of mechanical key-operated locks to incorporate electrical switch components typically has involved the use of a considerable number of individual parts stacked up on the rear end of the lock cylinder. Such arrangements increase the cost of production and assembly as well as imposing problems and difficulties in the type of assembly operations that can be performed. In addition, the ability to disembowel the lock to change keys and to change contact carrying elements has either been nonexistent or was present by way of a specialty design that is not easily accomplished.

One more recent approach toward eliminating the stack up arrangements of conventional switch locks in connection with an axial split pin tumbler type of lock is disclosed in Frank J. Scherbing U.S. Pat. No. 4,147,905 issued Apr. 3, 1979 and entitled "Sleeve and Terminal Holder Assembly For An Axial Split Pin Tumbler Type Switch Lock Mechanism". There, the pin tumbler sleeve and electrical contact actuating elements some of which being molded plastic members can be assembled somewhat like a so-called "Chinese puzzle" and then inserted into the lock cylinder as a unit. While that arrangement does provide elimination of many parts of a typical stacked up switch lock construction and the realization of cost savings in manufacture, it is essentially a single, specialty design of an axial pin tumbler lock and there is no real versatility of optional features that can be included with the same switch actuating components. Thus, a lock manufacturer with various types of locks and optional features available to be included with such locks would still not be able to offer the same set of elements for electrical switching to be applied with any of a number of such locks in the line. Also, the arrangement of the aforementioned patent as well as prior conventionally utilized forms of switch locks did not contemplate any provision for easy disembowelment to change keys and other elements of the lock after it was fixedly assembled.

Accordingly, it is the primary object of the invention to provide an improved switch actuating subassembly for a mechanical key-actuated lock which includes a relatively small number of easy to produce parts, affects cost savings in production and assembly, and which can be utilized in conjunction with a variety of forms of locks including various optional features readily available with such locks. It is a related object to provide an improved switch actuating subassembly that can be easily incorporated in the most commonly utilized size of axial pin tumbler lock casing with only a slight amount of modification being necessary to accommodate the switch mechanism.

Another object is to provide such an improved switch lock arrangement which permits the various components of the lock to be easily disassembled for re-keying and changing of the contact elements.

BRIEF DESCRIPTION OF THE DRAWINGS

These and other objects of the invention will become apparent from a description thereof which is to be read in conjunction with the following drawings depicting illustrative axial pin tumbler locks with switching capabilities according to the invention.

SUMMARY OF THE INVENTION

Briefly, and in accordance with the invention there is provided a switch lock subassembly, the components of which include a spindle rotatable, contact effecting member which has a peripheral skirt about a preselected arcuate portion of its periphery that defines a first part of a cam stop. Another contact effecting end terminal member includes an arcuate groove that interfits with and receives the peripheral skirt of the spindle rotatable contact member so that the two contact members coact with one another to make and break an electrical circuit upon rotation of the lock spindle with a proper key and in the proper degree of rotation permitted by the cam stops formed between the elements. The switching subassembly components are mutually interfitting and engage one another in a manner which permits ease of assembly with the lock and permits disassembly to allow for rekeying of the lock or changing the contact elements.

While the invention will be described in connection with certain preferred embodiments, it will be understood that it is not necessarily intended to limit the invention to those embodiments. On the contrary, it is intended to cover all alternatives, modifications and equivalents as may be included within the spirit and scope of the invention.

DETAILED DESCRIPTION

Figure 1:
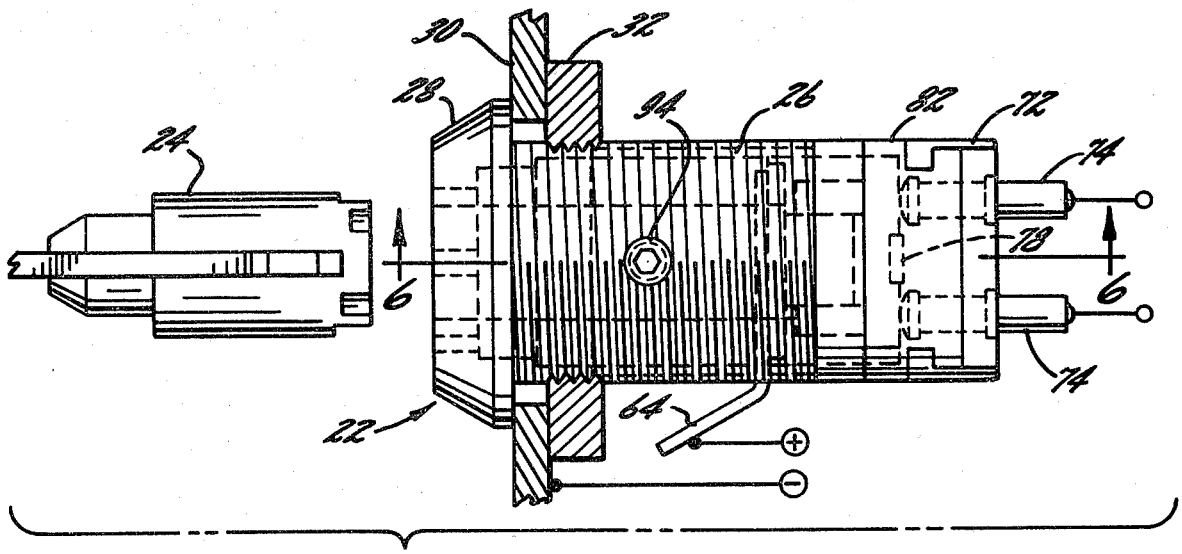
FIG. 1 is a side elevational view of an axial pin tumbler type of lock incorporating a switch mechanism assembly and the cooperating tubular key, in accordance with the present invention.

Turning to the drawings, there is illustrated in FIG. 1, a generally conventional appearing arrangement for an axial pin tumbler type of lock, indicated at 22, to be operated by a typical tubular key indicated at 24. Locks and keys of this general type are illustrated, for example, in U.S. Pat. Nos. 3,041,086 and 3,059,748. In addition, the instant lock 12 is also one which includes other features such as an alarm triggering switch mechanism associated with the tumbler pins. Locks of that type are illustrated in U.S. Pat. No. 4,078,405 and my copending U.S. application Ser. No. 175,761 filed Aug. 6, 1980.

As illustrated in FIG. 1, the lock 22 includes an elongated, threaded tubular body 26 with an enlarged frustoconical head 28 enabling the lock body to be captively held to a metal cabinet 30 or the like by mounting nut 32, again in a conventional manner.

Figure 2:
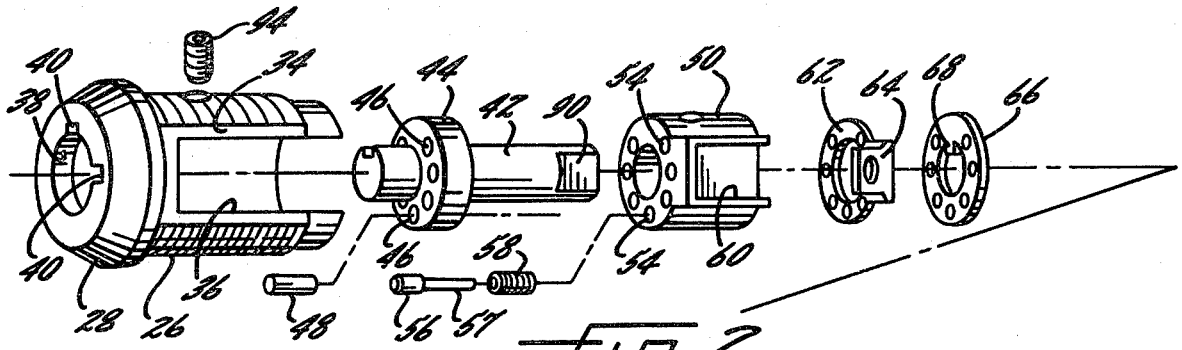
FIG. 2 is an exploded perspective view of the lock mechanism of FIG. 1, on a reduced scale.
Figure 4:
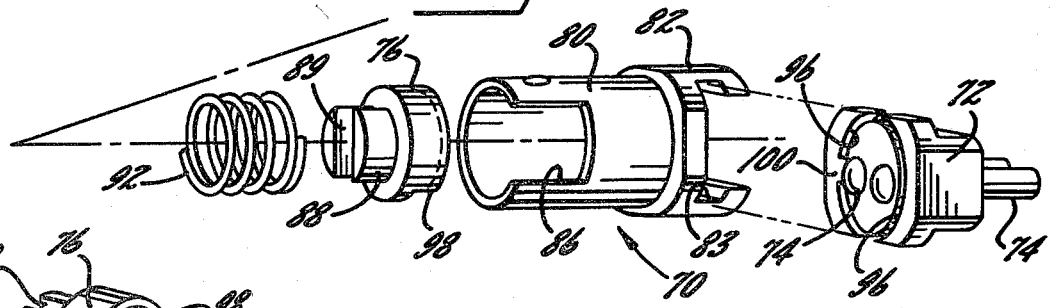
FIG. 4 is a perspective view of the second contact element of the switching subassembly.
Figure 4:
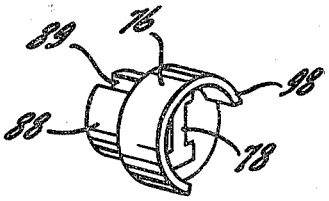
Figure 5:
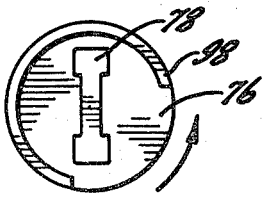
FIG. 5 is an enlarged rear elevational view of the second contacting element illustrated in FIG. 4.
Figure 3:
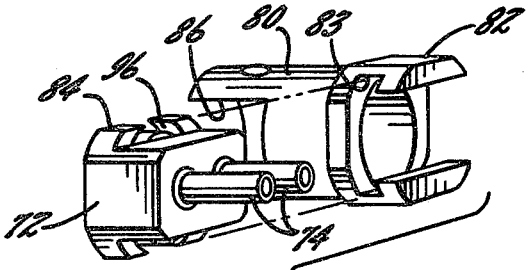
FIG. 3 is an exploded perspective view of the first contact effecting element and holding member of the lock switching subassembly.

Referring to FIG. 2 which is an exploded view of the lock 22, the upper portion of the figure illustrates components as described in my aforesaid copending application which provides the additional features of the alarm triggering capability through the pins and the torque inhibiting structure to resist picking efforts. It will be appreciated as the discussion proceeds, that these added options or features need not be present in a lock which incorporates the switching subassembly of the present invention, but are illustrated here to show the versatility of the invention. Thus, the lock body 26 which has a longitudinally extending bore includes a flat portion 34 on the wall and a cutout 36. The frustoconical head 28 includes a reduced diameter opening 38 corresponding with the outer diameter of the tubular key 24 and cooperating slots 40 provided for the key lug (not shown). The operational element of the lock mechanism is the spindle 42 which carries affixed thereto a driver pin sleeve 44 having a plurality of spaced longitudinally extending bores 46. This particular axial pin tumbler lock as shown is a 7-pin tumbler type so that there are the same number of driver pins 48 disposed in each of the bores 46, although only one such driver pin 48 is here shown.

A stationary tumbler sleeve 50 having a central longitudinally extending bore for receiving the spindle 42 contains a plurality of spaced tumbler bores 54, each of which receives a tumbler locking pin 56 having a stem 57 and spring element 58. With the driving and locking tumbler pins in place and the spindle seated on the stationary sleeve 50, the locking mechanism when assembled to the lock body 26 would prevent rotation of the spindle 42 unless and until the proper key is inserted and the shear planes between the driver pins 48 and locking pins 56 are aligned between the interface of rotatable sleeve 44 and stationary sleeve 54.

In order to provide for the alarm triggering capability through the pins, the stationary sleeve 50 has a generally rectangular boss 60 which is received in the rectangular cutout 36 of housing 26. An annular electric contact element 62 having a bent over prong 64 is received at the rear end of the sleeve 50. The contact element 62 made of an electrically conductive material includes a plurality of bores corresponding to the locking tumbler bores 54 of the stationary sleeve. Contact element 62 when in position is stationary with the stationary sleeve 50 and the stems 57 of tumbler pins 56 will form the other contact member when the pins 56 are manipulated so that the stems 57 project out through the stationary sleeve bores as might occur when there is an attempted picking. An annular insulating ring 66 which also has a plurality of longitudinally extending bores corresponding with the bores of contact ring 62 and the stationary sleeve 50 bores is received by the rearward end of the spindle 42. Insulating ring 66 has an inwardly projecting lug 68 which fits within a slot formed in the spindle so that the ring 66 is rotatable with the spindle. The ring 66 serves to preclude the application of torque to the spindle when the pins are manipulated by picking actions.

Assembly of the components thus far described provides a lock which includes all the features of the lock disclosed in my aforesaid copending application which will now serve as illustrative of a full feature lock.

In accordance with the present invention, switch lock subassembly means is provided to be received by the rear of the lock housing in a manner such that rotations of the key in the lock will open and close electrical circuit contacts to render the lock operable as a switch lock. As illustrated in the lower portion of FIG. 2, the switching element subassembly, generally indicated at 70 includes a T-shaped first contact effecting member 72 which carries a pair of terminals 74, a second contact effecting member 76 which carries a bridging element 78 and a holder sleeve 80 for carrying the first and second contacting elements. The holder sleeve has an enlarged head portion 82 which has a T-shaped slot at its rear end so that the T-shaped end 84 of the first contact member 72 slidably interfits the sleeve slot 83. Sleeve 80 also has a rectangular cutaway 86 which allows it to fit around the boss 60 of stationary sleeve 50.

Figure 6:
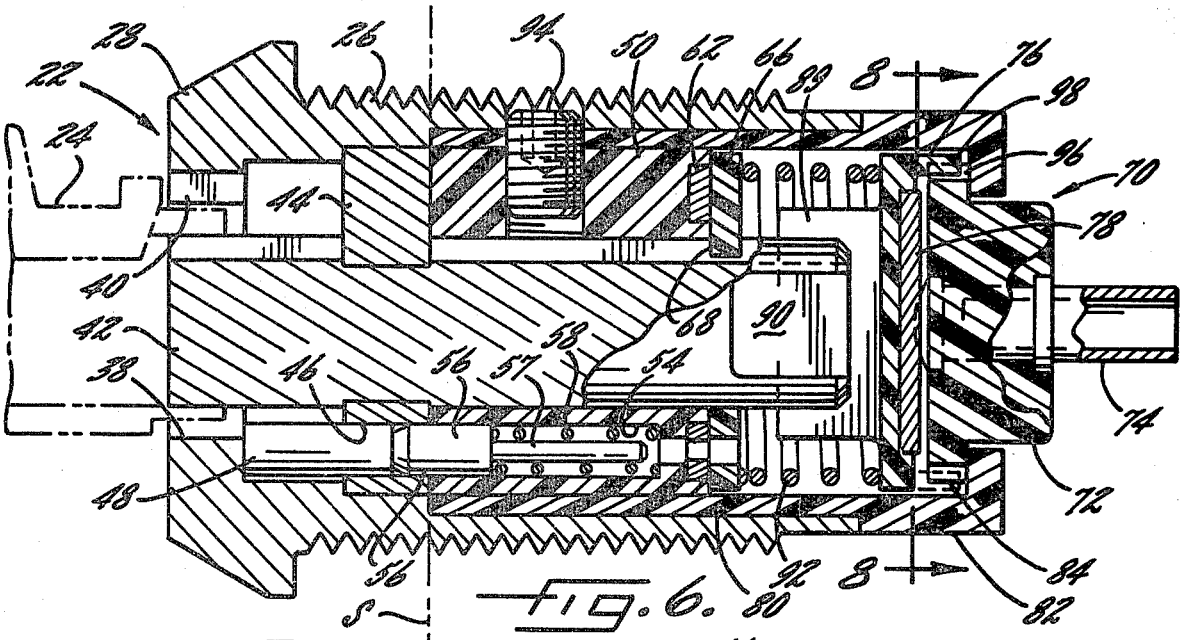
FIG. 6 is an enlarged longitudinal sectional view of the lock in FIG. 1 shown in the locked, switch off position and taken substantially along the line 6—6 in FIG. 1.

In keeping with the present invention, the second contact member 76 has the reduced diameter portion 88 which includes a transverse slot 89 that is adapted to receive the flattened end portion 90 of spindle 42. The spring 92 surrounds the reduced portion 88 of the second contact element 76 and serves to urge the second contact element rearwardly in the sleeve 80 towards the first contact element 72. The individual components that have been described will all fit together within the lock casing 26 as best shown in FIG. 6 and are preferably held in place by a self tapping set screw 94.

Components such as stationary sleeve 50, insulator sleeve 66 and holder sleeve 80 may be readily and economically produced of nonconductive material, such as glass filled nylon by way of molding operations. The contact element members 72 and 76 which are also insulating material are preferably constructed of a thermoset plastic and have the metallic contact elements 74 and 78, respectively embedded therein.

Figure 7:
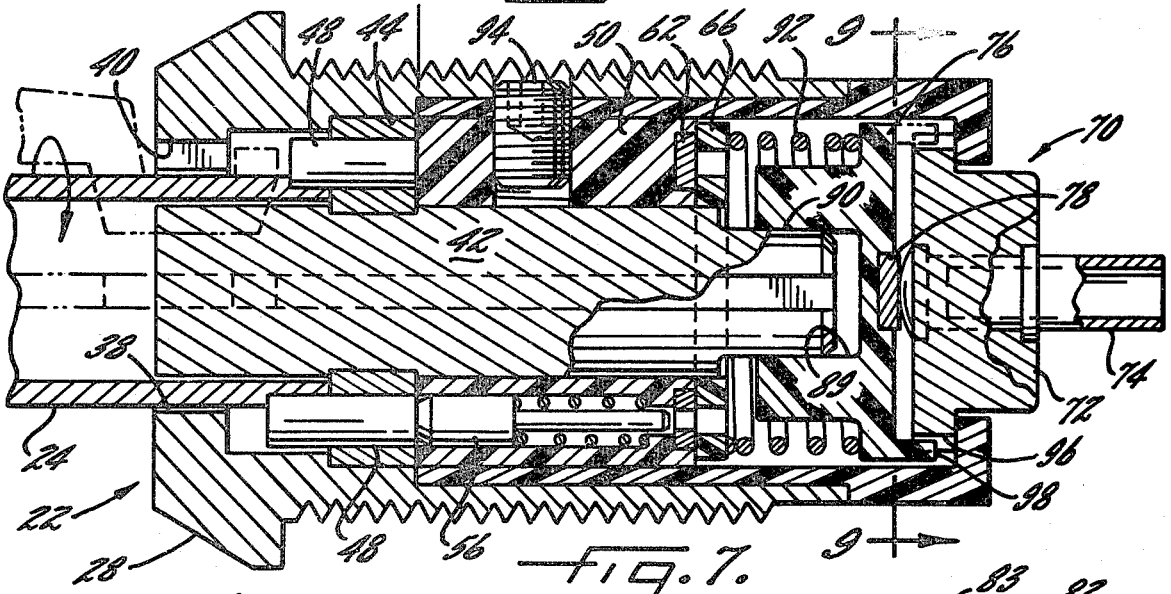
FIG. 7 is an enlarged longitudinal sectional view of the lock in FIG. 1, here shown in the rotated switch connection position.
Figure 8:
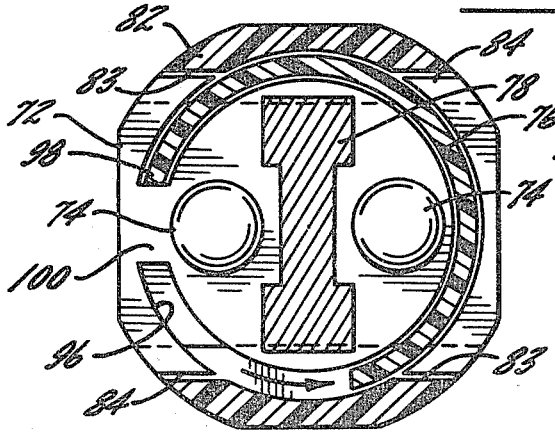
FIG. 8 is a transverse sectional view taken substantially along the line 8—8 in FIG. 6.
Figure 9:
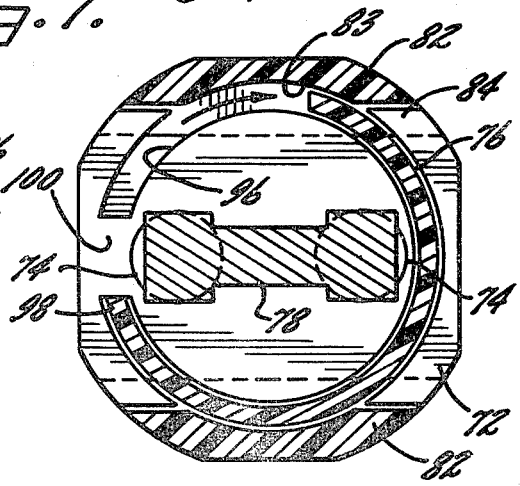
FIG. 9 is a transverse sectional view taken substantially along the line 9—9 in FIG. 7.

In accordance with another aspect of the present invention, the first and second contact members 72, 76 interfit and coact with one another not only to make and break an electrical circuit upon rotation of the lock, but also provide the proper degree of rotation by way of cam stops formed therebetween. To this end, the first contact member 72 has an arcuate groove 96 on its face surrounding the terminal 74 inward ends and contact element 76 has an arcuate peripheral skirt 98 projecting forwardly from the face carrying bridge contact 78. The peripheral groove 96 in contact member 72 is interrupted by the abutment 100 and the peripheral skirt 98 of contact member 76 has an arcuate void which together with the abutment 100 defines the angular extent to which the lock may be rotated between the opened and closed positions or "switch on" and "switch off" positions. As best shown in FIGS. 6 and 8, in the locked position the upper left end of the peripheral skirt 98 as viewed in FIG. 8 is against the abutment 100 defining the extreme counter-clockwise rotation limit of the lock. The bridging contact element 78 is shown vertically out of contact with the terminal members 74. When the key 24 is inserted in the lock and rotated as illustrated in FIGS. 7 and 9, the peripheral skirt 98 moves clockwise until the lower left side end strikes the abutment 100 defining the extreme clockwise movement of the lock. In the present instance the arrangement is such that complete rotation is at about 90° and the contact element 78 bridges the contact terminals 74.

Figure 10:
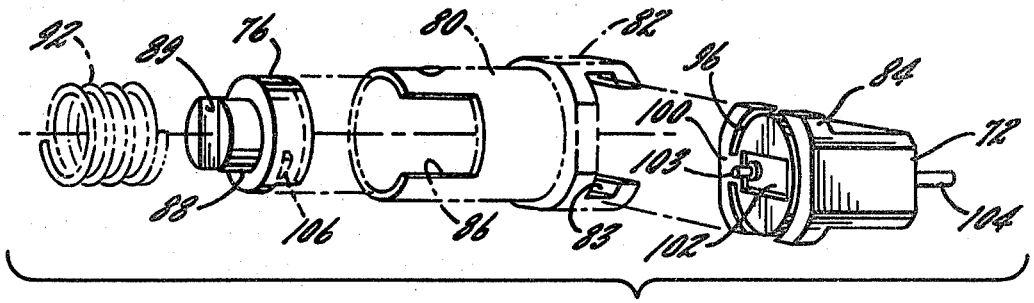
FIG. 10 is an exploded perspective view of a lock switching subassembly where the first element is a self-contained miniature switch member.
Figure 11:
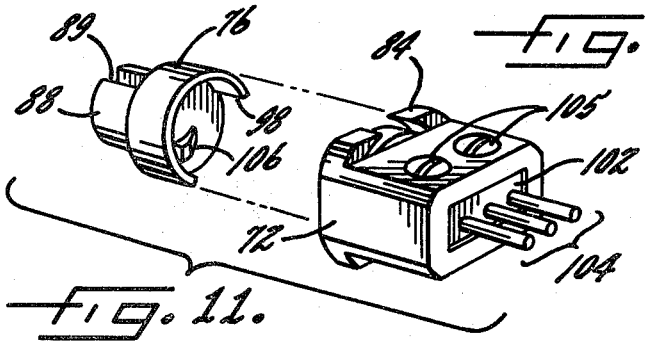
FIG. 11 is a perspective view of the switch operating elements of the subassembly in FIG. 10.
Figure 12:
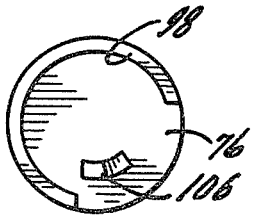
FIG. 12 is an enlarged rear elevational view of the second contact operating member shown in FIG. 11.
Figure 13:
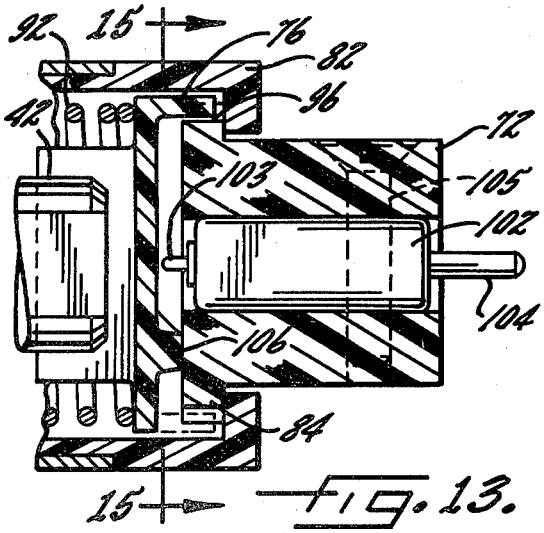
FIG. 13 is a fragmentary enlarged sectional view of the rear portion of the switch subassembly of FIG. 10 as it would be assembled and in the disconnect position.
Figure 14:
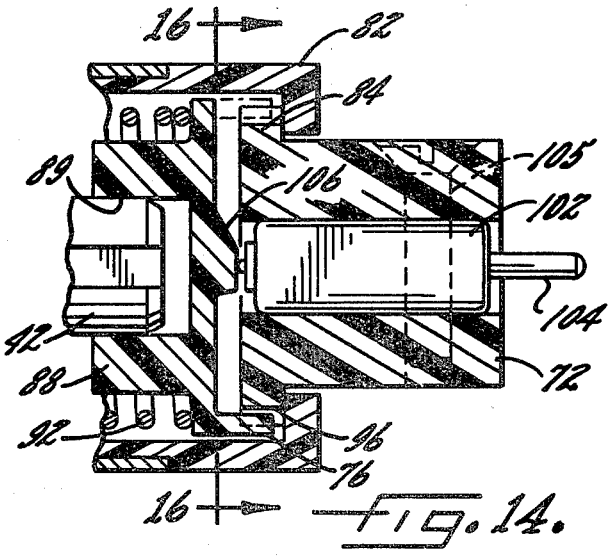
FIG. 14 is an enlarged fragmentary sectional view similar to FIG. 13, here shown with the lock rotated to the switch actuating position.
Figure 15:
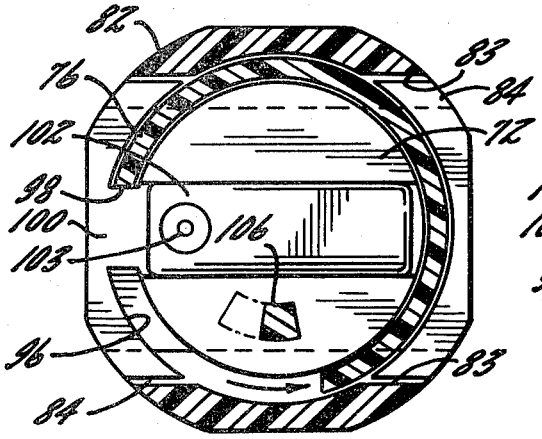
FIG. 15 is a transverse sectional view taken substantially along the line 15—15 in FIG. 13.
Figure 16:
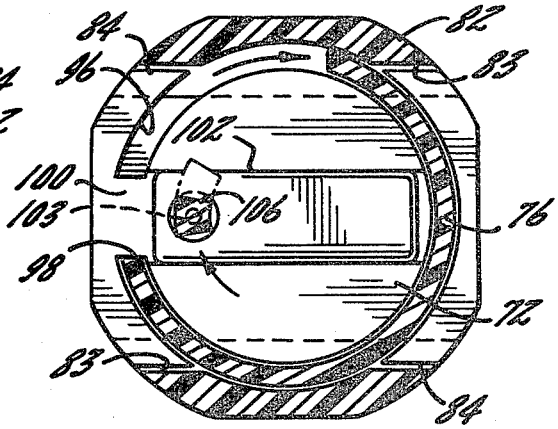
FIG. 16 is a transverse sectional view taken substantially along the line 16—16 in FIG. 14.

Turning now to FIG. 10, there is shown an exploded part arrangement of a slightly modified version of the instant invention where essentially the same components of the switch subassembly are utilized to actuate a miniature switch carried in the first contact member. Holder sleeve 80 remains the same as in the arrangement shown in FIGS. 1–9. The first contact member 72 is modified so that it includes a central cavity which can receive a self-contained miniature switch 102 providing a small push-button contact operating element 103 projecting forwardly and terminal ends 104 projecting rearwardly. The switch structure is held in place by screws 105 (FIG. 11). It will be appreciated in this arrangement the switch element being a self-contained miniature or "micro-switch" can be a double throw switch as shown or other numbers of terminal activations made available and such switches can be substituted. Also, the switching element can be readily replaced. In the present instance the second contact element member 76 is modified so that the internal face includes a ramp member 106 which activates the switch push-button 103 when the key operated lock is rotated as viewed in FIGS. 14 and 16. The opposite rotation of the lock to the positions illustrated in FIGS. 13 and 15 moves the ramp 106 away from bush-button 103 which is then free to move outward to open or close contacts within the switch 102.

Figure 17:
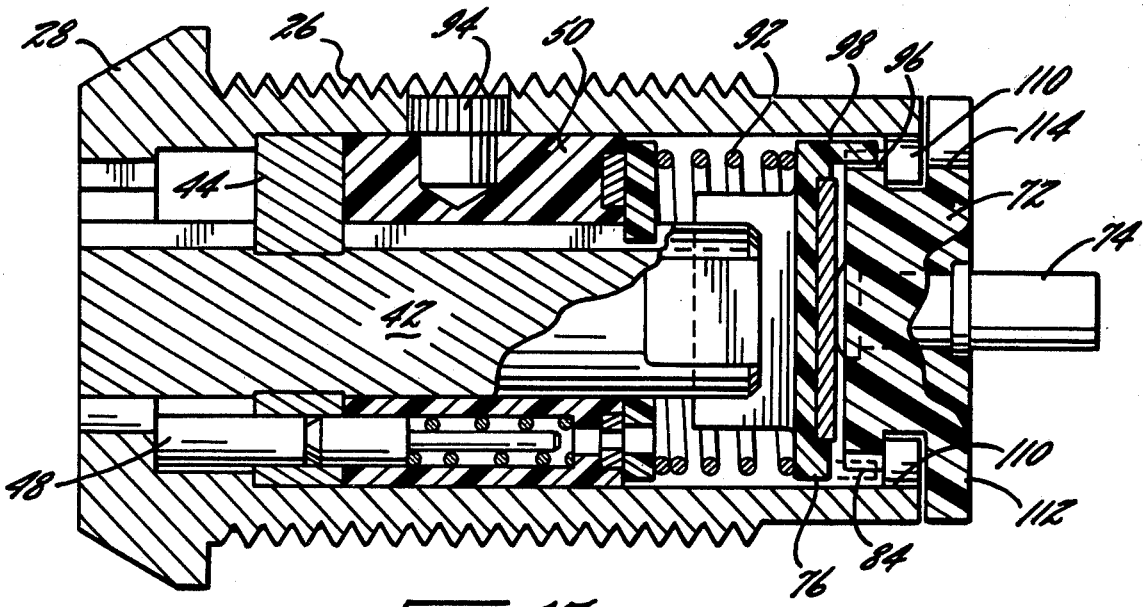
FIG. 17 is an enlarged longitudinal sectional view of a modified version of a lock switching subassembly in accordance with the present invention.
Figure 20:
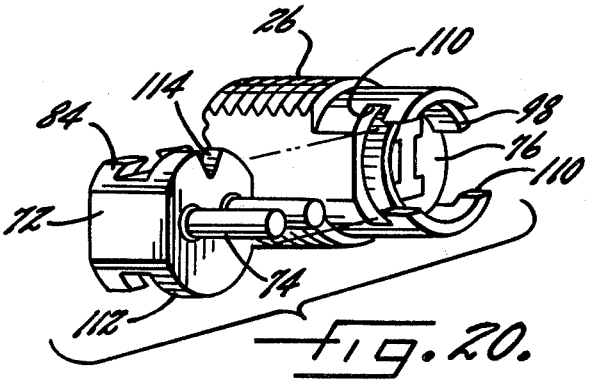

Referring now to FIG. 17, there is here shown a further slightly modified version of the instant invention, where the sleeve holder member 80 is eliminated and the tubular lock casing 26 itself is slightly extended and has T slots 110 cut through the casing wall (FIG. 20). The contact effecting member 72 which is here shown carries a pair of terminals 74 has the T-shaped end 84 which slides into the T-shaped slots 110 now formed on the housing 26. The contact element 72 is also shown with other ribs 112 to cover over the otherwise left arcuate voids on opposite sides of the casing ends.

Insofar as assembly is concerned, after the mechanical locking elements are fixed within the casing by pin or self-tapping screw 94, spring 92 is inserted around the spindle end and the second contact effecting element 76 is positioned to engage the spindle. While depressing the second contact element 76, the first contact number 72 is slid in place within slots 110. When the contact number 72 is in place the peripheral skirt portion 98 of contact number 76 enters the groove of contact number 72 thereby holding the number 72 from sliding movement in the same way that would occur with the previous embodiments.

Figure 18:
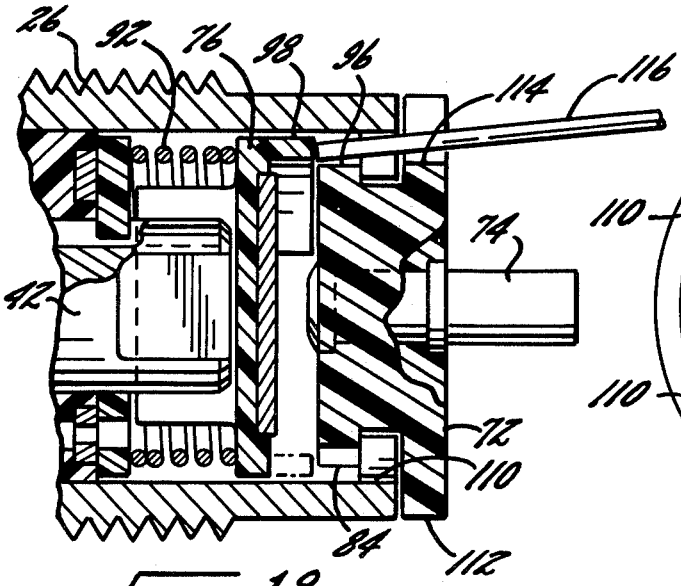
FIG. 18 is a fragmentary sectional view of the rearward portion of the lock shown in FIG. 17 and here illustrating insertion of a pin member to depress the second contact element away from the first contact element.
Figure 19:
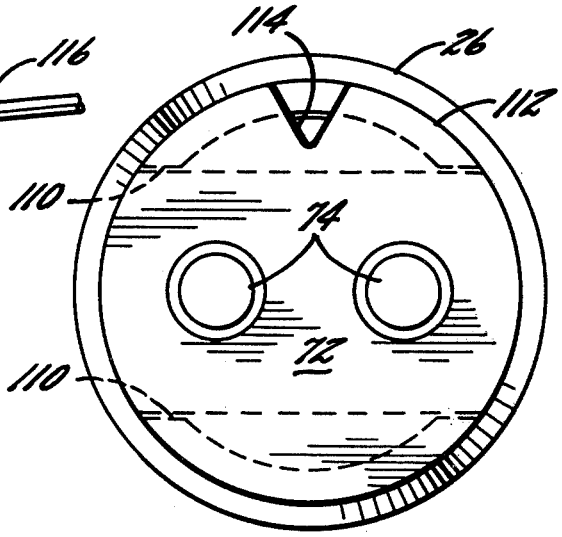
FIG. 19 is an enlarged rear elevational view of the switch lock illustrated in FIG. 17; and, FIG. 20 is a perspective explosive view of the first contact member and lock casing fragmentary rear portion illustrating the manner in which the parts connect together.

In accordance with still another aspect of the present invention, provision may be made for disassembling the switch contact subassembly. To this end, a small opening here shown in the form of a V-notch 114 is provided (FIGS. 19 and 20) in the contact holder member 72 so that a small rod or pin 116 (FIG. 18) can be inserted from the back to depress the contact member 76 releasing its skirt 98 from the groove 96 and enabling the contact holder member 72 to be slidably removed. Once the contact holder member 72 is removed, the contact holder member 76 is free to come out of the casing 26. With the present arrangement that can also be used with the embodiments of FIGS. 1–16, the contact members can be changed or substituted as may be desired.

I claim as my invention:

1. In a lock having a cylinder and key actuated spindle means disposed in said cylinder, a switch operating subassembly adapted to be operated by rotation of the spindle means through use of a proper key, comprising, a first contact effecting member having means for removably coupling said first member stationarily to said cylinder, a second contact effecting member adapted to be coupled to said spindle means for rotation therewith, said first and second contact effecting members being interfitting and having mutually engaging stop means to limit rotation of said spindle means and said second contact effecting member by a predetermined arcuate amount, at least said first contact effecting member having electric switch contact elements associated therewith, said second contact effecting member having means for opening and closing a circuit with said electric switch contacting elements, spring means interposed between the lock spindle means and second contact effecting member urging and holding the latter in interfitting engagement with the first contact effecting member, said first contact effecting member including opening means at the rear so that a rod like tool inserted therein depresses the second contact effecting member releasing the interfitting engagement and said means for removably coupling the first contact effecting member to the cylinder including means for enabling sliding removal of the first contact effecting member upon release of the interfitting engagement with said second contact effecting member.

2. A switch operating subassembly for a key actuated lock as claimed in claim 1 wherein said interfitting stop means on said first contact effecting member comprises an arcuate groove and the corresponding stop means on the second contact effecting member comprises a peripheral arcuate skirt, and interfitting of the said groove and skirt forming the retention means in assembly of the first contact effecting member.

3. A switch operating subassembly for a lock as claimed in claim 1 wherein said contact effecting member contact elements are terminals and said second contact effecting member includes a conductive bridging element which comprises the means for opening and closing the circuit with said terminals.

4. A switch operating subassembly for a lock as claimed in claim 1 wherein said first contact effecting member switch contact elements comprise a separate miniature switch mounted in said first member and having an operating member directed toward said second contact effecting member, said second contact effecting member including means for opening and closing the switch circuit comprising a ramp movable into and out of engagement with the switch operating member upon rotation of the key actuated spindle means.

5. The switch subassembly for a lock as claimed in claim 1 wherein said opening in said first contact effecting member comprises a V-shaped notch.

6. In a lock having a cylinder and key actuated spindle means disposed in said cylinder, a switch operating subassembly adapted to be operated by rotation of the spindle means through use of a proper key, comprising, a first contact effecting member having means for removably coupling said first member stationarily to said cylinder, a second contact effecting member adapted to be coupled to said spindle means for rotation therewith, said first and second contact effecting members being interfitting and having mutually engaging stop means to limit rotation of said spindle means and said second contact effecting member by a predetermined arcuate amount, at least said first contact effecting member having electric switch contact elements associated therewith, said second contact effecting member having means for opening and closing a circuit with said electric switch contacting elements, said means for removably coupling said first contact effecting member to said cylinder including a sleeve holder removably insertable into said lock cylinder.

7. A switch operating subassembly for a lock as claimed in claim 6 wherein said removable coupling means for said first contact effecting member and said cylinder comprises cooperating T-shape connections between the sleeve holder and first contact effecting member.

8. In a lock having a cylinder and key actuated spindle means disposed in said cylinder, a switch operating subassembly adapted to be operated by rotation of the spindle means through use of a proper key, comprising, a first contact effecting member having means for removably coupling said first member stationarily to said cylinder, a second contact effecting member adapted to be coupled to said spindle means for rotation therewith, said first and second contact effecting members being interfitting and having mutually engaging stop means to limit rotation of said spindle means and said second contact effecting member by a predetermined arcuate amount, at least said first contact effecting member having electric switch contact elements associated therewith, said second contact effecting member having means for opening and closing a circuit with said electric switch contacting elements, said removable coupling means for said first contact effecting member and said cylinder comprising a cooperating T-shape on said first contact effecting member and T-shaped slots on said cylinder so that said member slidably engages with said cylinder.

* * * * *